US006082976A

United States Patent [19]

Kempf et al.

[11] Patent Number: 6,082,976

[45] Date of Patent: Jul. 4, 2000

[54] CIRCULATING PUMP

[75] Inventors: Dale Kempf, Clovis, Calif.; Kjeld Hellegaard, Bjerringbro, Denmark; Ken Lum, Fresno, Calif.

[73] Assignee: Grundfos Manufacturing Corporation, Fresno, Calif.

[21] Appl. No.: 09/195,780

[22] Filed: Nov. 18, 1998

[51] Int. Cl.[7] ..... F04B 17/00

[52] U.S. Cl. ..... 417/423.14; 72/370.01; 417/423.1

[58] Field of Search ..... 417/360, 423.1, 417/423.14; 415/214.1; 72/370.01

[56] References Cited

U.S. PATENT DOCUMENTS

| | | | |
|---|---|---|---|
| 3,306,222 | 2/1967 | Simcox | 417/423.14 X |
| 3,824,035 | 7/1974 | Liang | 417/423.14 X |
| 3,936,220 | 2/1976 | Henderson | 415/178 |
| 3,969,040 | 7/1976 | Hamm et al. | 417/292 |
| 4,436,486 | 3/1984 | Jensen et al. | 417/45 |
| 4,878,804 | 11/1989 | Akerman et al. | 415/111 |
| 5,613,845 | 3/1997 | Moon | 417/423.11 |
| 5,618,168 | 4/1997 | Moon | 417/423.11 |
| 5,624,244 | 4/1997 | Moon | 417/366 |

FOREIGN PATENT DOCUMENTS 26 40 374 3/1978 Germany .

*Primary Examiner*—Tony M. Argenbright
*Attorney, Agent, or Firm*—Richard A. Ryan

[57] ABSTRACT

A circulating pump having a pump housing made of non-metallic materials, such as plastic, composite or other moldable materials. The use of a non-metallic housing facilitates the use of features which are difficult or expensive to obtain with a metal cast housing. A U-bolt or other clamping member couples the pump housing between the pump motor and a metallic tubular manifold to place the housing in compression between the motor and manifold to virtually eliminate tensile and bending stresses in the pump housing and, thereby, reduce the possibility of structural degradation from exposure of the non-metallic housing to fluids. The manifold has a shaped portion having a planar surface thereon that abuts the housing and provides a surface for one or more sealing members between the manifold and the housing. The metallic manifold allows the circulating pump to be installed in a metallic piping system utilizing conventional installation materials and methods. A check valve can be installed in the housing to eliminate the need for multiple connections and in a manner that allows the check valve to be field serviceable without removing the pump from the piping system. A method for making the tubular manifold is also presented.

37 Claims, 7 Drawing Sheets

CIRCULATING PUMP

BACKGROUND OF THE INVENTION

1. Field of the Invention

The field of the present invention relates generally to circulating pumps for use in home or industrial water supply systems and, more particularly, to circulating pumps of the type having a housing and manifold attached to a pump motor for installation in a piping system. Even more particular, the present invention relates to such circulating pumps having a housing made from composite or other moldable, non-metallic materials.

2. Background

Circulating pumps are frequently used in piping systems requiring circulation of water. One common example of such use is in the re-circulation of hot water in a hot water supply system used to distribute hot water throughout a house and to a heat exchanger that provides central heating for the house. The circulating pump is usually soldered or brazed into the plumbing system to circulate the water under pressure. The typical circulating pump has an inlet that supplies water to the pump through a manifold, a pump housing or volute having a spiral, round or other shaped impeller chamber, an impeller located in the chamber and a power head (such as an electric motor having a motor housing, stator, bearings, shaft, etc.) to drive the impeller. This type of circulating pump is connected in-line to the standard piping system.

Typically, the various components of a circulating pump are manufactured from metallic materials, such as copper, brass or bronze. In order to obtain the desired shape and finish for these pumps, the pump housing is cast from the metallic material and machined to final shape, making it expensive to manufacture. If the pump is made of an alloy that does not contain lead, as frequently desired by circulating pump users, the materials are generally more expensive, more difficult to machine, more difficult to braze into the plumbing system and more difficult to cast without porosity, therefore making the pump even more expensive to manufacture. An advantage of the metallic cast circulating pump is that users of the pump are familiar with a cast metal pump and can quickly and easily braze the pump into the plumbing system, which is typically comprised of metal piping made of copper or brass.

A circulating pump made of non-metallic material, such as plastic or various composite materials (such as glass and/or mineral reinforced plastic), could avoid many of the problems described above with a cast metal pump. A major disadvantage of a non-metallic circulating pump is that most users are not familiar with connecting a non-metallic pump to a metal plumbing system (i.e., copper tubing) and/or lack confidence in its ability to perform under operating conditions. Because of the lack of experience or confidence, users avoid non-metallic pumps. Concerns regarding dripping leaks and catastrophic failures, which are typically the major liability concern for pump makers or those who install circulating pumps in their systems or equipment, only reinforce the decision to avoid non-metallic pumps.

The typical pump housing comprises a manifold having inlet and pressure side ports, which are cast with the pump housing as a single piece. The pump inlet and pressure side ports are brazed to the metallic piping of the plumbing system. The pump unit, including the pump motor, is supported by the metallic piping. Because the metal manifold and pump unit are brazed to the piping, the unit will not move relative to the piping. If, however, the unit comprises a pump housing with a tubular shaped manifold that is not brazed to the piping system (i.e., one utilizing a joint of telescoping tubular members sealed but not bonded), then the moment force from the overhung weight of the motor about the piping centerline can cause the pump unit to slip and move in a rotary motion about the piping (when the piping is in a horizontal position). This tendency to slip has been a further drawback to the use of a non-metallic pump housing.

To prevent undesirable thermal siphoning of heating system hot water through the pump, a check valve is provided downstream of the pressure side of the pump in the typical circulating pump piping system. The use of the check valve adds additional connections in the plumbing system, which requires more time and results in greater installation cost. For the check valve to be field replaceable, a removable gasketed opening must also be provided. In addition to the cost, the use of the check valve provides multiple additional locations for potential connection failures or leaks.

SUMMARY OF THE INVENTION

The circulating pump of the present invention solves the problems identified above. That is to say, the present invention provides a circulating pump having a housing made of plastic, composite or other relatively low cost moldable material attached to a metallic manifold that is easily installed in the metallic piping used in the typical plumbing system. The non-metallic, moldable housing allows features to be included in the pump housing that would be difficult to include in a metal cast housing and/or would require extensive machining. The use of the non-metallic, moldable housing also allows the use of an internal check valve to eliminate the necessity of an external check valve in the piping system.

In the primary embodiment of the present invention, the circulating pump housing is made from a molded thermoplastic or composite material. Examples of such materials include various hydrolysis-resistant, chemically inert polymers such as polythalamide and polyphenylene sulphide made by Amoco, Phillips and others. The non-metallic pump housing can have gaskets (such as flat or shaped gaskets) or O-ring grooves and O-rings to seal the pump housing against a metallic manifold having a shaped portion therein or attached thereto. The manifold can be made of various metals, such as copper or brass, which can be soldered or brazed into a metallic plumbing system. The preferred manifold is a tubular member having a generally D-shaped portion that has a planar upper surface where the pump housing connects to the manifold. The inlet side of the shaped portion has a first manifold port that connects to the pump housing inlet port and the pressure side of the shaped portion has a second manifold port that connects to the discharge port of the pump housing. A manifold plug located between the two manifold ports forms inlet and discharge passages that direct the hydraulic path in and out of the pump ports. In the preferred embodiment, a U-bolt holds the non-metallic pump housing to the shaped portion of the manifold and couples the housing and manifold to the pump power head.

The use of a metallic manifold, having the pump and power head coupled thereto and sufficient length of inlet and discharge piping on either side of the pump housing, allows a non-metallic pump housing to be connected to the metallic piping in a conventional plumbing system by way of soldering or brazing without damaging the non-metallic housing. Because the manifold is coupled to the flat side of the pump housing and the manifold is brazed directly to and in-line with the piping system, the pump unit will not slip due to the moment force caused by the overhanging motor.

The circulating pump of the present invention overcomes user concerns regarding the use of a non-metallic pump by eliminating the need for the user to connect a non-metallic component to the metallic piping in the plumbing system. Because the manifold is made of metal material, such as copper or brass, which the user is familiar with, the concerns regarding a leaking non-metallic to metal connection are eliminated. The location of the non-metal pump housing between the metal manifold and metal power head should substantially improve the user's confidence in the life of the pump housing. The fact that the non-metallic pump housing is placed in compression by the U-bolt or other connector reduces the likelihood of structural degradation, whether perceived or actual, that could result in old-age failure due to age and environmental exposure. Clamping the non-metallic pump housing between the metallic manifold and power head virtually eliminates any significant tensile and bending stresses in the pump housing, thereby greatly reducing the likelihood of failure, even after long exposure to chemical and aqueous degrading solutions.

In the preferred embodiment, the seals (i.e., gasket or O-ring) utilized in the pump of the present invention are securely clamped into place between the pump housing and the manifold and between the pump housing and the power head by the U-bolt. Also in the preferred embodiment, the pump of the present invention includes a check valve located in the discharge port of the pump. The check valve is serviceable in the field by merely removing the motor from the pump housing, without having to remove the pump from the piping system. The pump can be put together as a unit (i.e., the manifold, housing and power head) by the pump manufacturer at the manufacturer's facility, thereby eliminating the need for the user to have to attach or directly manipulate the non-metallic housing.

Accordingly, the primary objective of the present invention is to provide a circulating pump that has a non-metallic pump housing suitable for installation into a metallic piping system.

It is also an important objective of the present invention to provide a circulating pump having a non-metallic pump housing and a hydraulically connected manifold operatively coupled to a power head, such as an electric motor.

It is also an important objective of the present invention to provide a circulating pump having a non-metallic pump housing coupled between a metallic power head and a metallic manifold at a generally planar location on the manifold such that the pump housing is kept in compression and the manifold is suitable for installation into a metallic piping system.

It is also an important objective of the present invention to provide a circulating pump having a metallic manifold that isolates a composite pump housing from piping loads and that transmits such loads between the manifold inlet and discharge ends without distortion to the manifold, up to the maximum load imposed by conventional soldered copper tube plumbing without yielding of the plumbing.

It is also an important objective of the present invention to provide a circulating pump that utilizes a field serviceable check valve in a non-metallic pump housing.

It is also an objective of the present invention to provide a relatively low cost moldable pump housing for connection to metal piping in a plumbing system.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
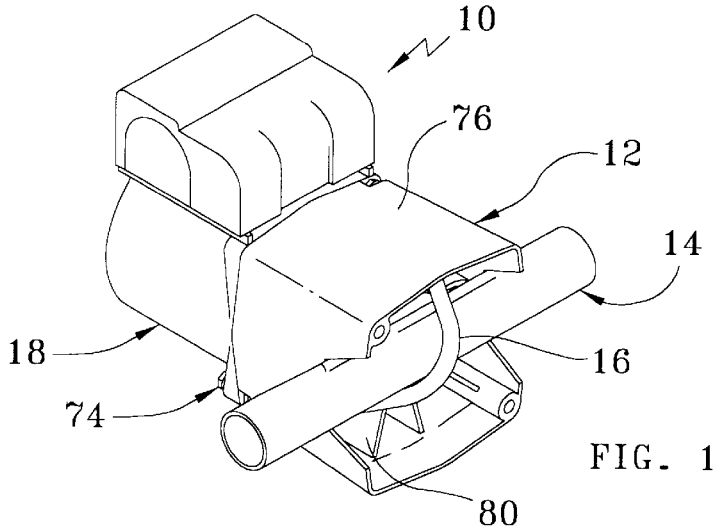
FIG. 1 is a perspective view of an assembled circulating pump unit utilizing the preferred embodiments of the present invention.
Figure 2:
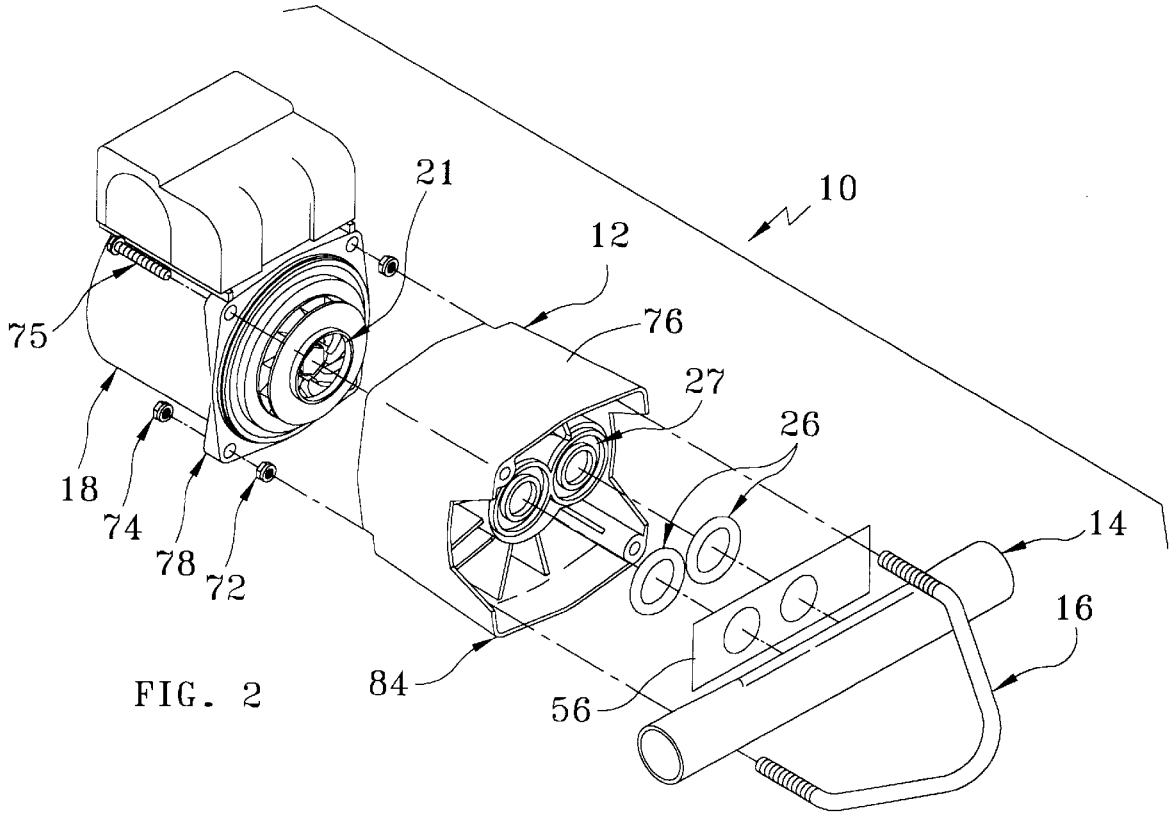
FIG. 2 is an exploded view of the pump unit in FIG. 1.

With reference to the figures where like elements have been given like numerical designations to facilitate the reader's understanding of the present invention, and particularly with reference to the embodiment of the present invention illustrated in FIGS. 1 through 14, the preferred embodiment of the circulating pump of the present invention is designated generally as 10. Circulating pump unit 10 has a pump housing 12 connected to manifold 14 by U-bolt 16. As shown in FIGS. 1 and 2, U-bolt 16 tightly couples manifold 14 and pump housing 12 to a power head such as an electric motor 18.

Pump housing 12 is made of a moldable, non-metallic material such as plastic or composite materials. The composite materials include such materials as fiber or mineral reinforced plastic. The use of such non-metallic materials results in a lower cost pump housing 12 that can be manufactured in a variety of sizes and shapes having pump features that would be difficult to obtain with a metal cast housing (i.e., bronze or brass) or which would require extensive finishing or machining, resulting in a pump that is too expensive for the typical circulating pump use. Pump housing 12 has an impeller chamber 20, in which is disposed an impeller 21, in fluid communication with an inlet port 24 and a discharge port 25.

In the preferred embodiment, impeller chamber 20 is of a volute form, although other configurations will also work with the present invention. Also in the preferred embodiment, the volute expands axially (i.e., helix shape with progression toward the discharge port 25) rather than the more conventional radial expansion (i.e., spiral). The helix shaped impeller chamber 20 allows use of a larger impeller 21 without the use of undercuts in the pump housing 12. Also in the preferred embodiment, inlet port 24 and discharge port 25 are both shifted eccentric such that both inlet 24 and discharge 25 ports, as well as any surrounding seals (such as O-rings 26) and sealing grooves (such as O-ring grooves 27), are within a smaller area concentric with the centerline of the pump housing 12. Such a configuration avoids the requirement of a thick wall, which is difficult to mold, adjacent to the discharge port 25.

Figure 3:
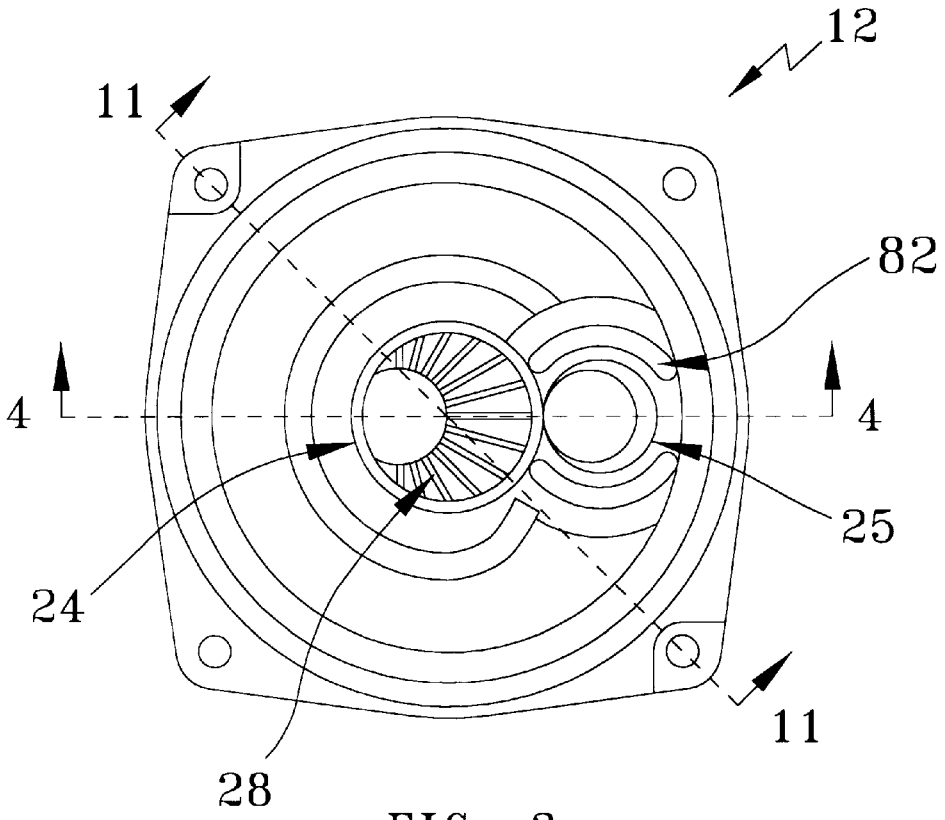
FIG. 3 is a view of the pump housing from the motor side of the pump unit of FIG. 1.
Figure 4:
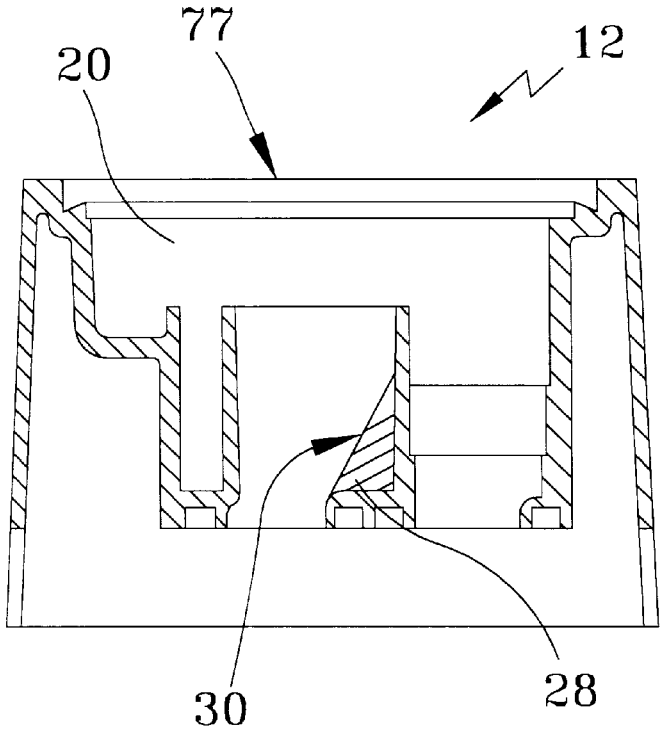
FIG. 4 is a cross-sectional view of the pump housing taken through line 4—4 in FIG. 3.

To avoid the turbulence in the inlet port 24 area and high stress concentration from pressure-induced bending that could result from the eccentric placement of inlet port 24, pump housing 12 can utilize a plurality of fins 28 radially arranged in inlet port 24, as best shown in FIGS. 3 and 4. The fins 28, having angled surfaces 30, provide a good hydraulic transition through inlet port 24 and function as gussets to provide structural support to inlet port 24. Fluid can flow between fins 28, but the narrow spacing and diverging nature of the fluid flow path reduce the likelihood of turbulence and the formation of eddies, which can result in detrimental cavitation. As gussets, fins 28 prevent the severe bending stress that can result from relatively high internal system pressure from damaging the pump housing 12.

Figure 5:
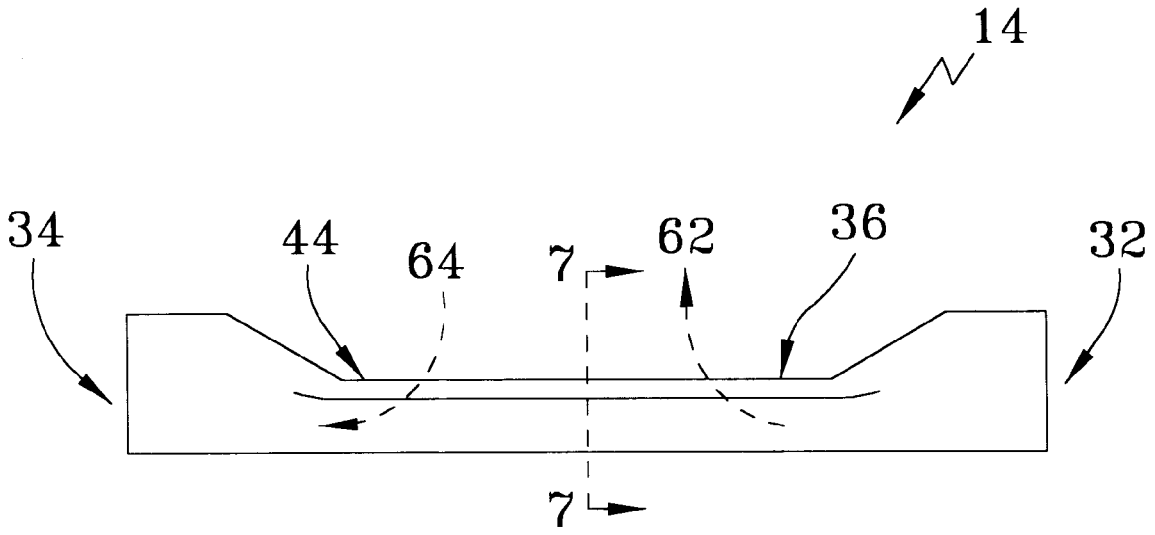
FIG. 5 is a side view of the tubular manifold of the preferred embodiment.
Figure 6:
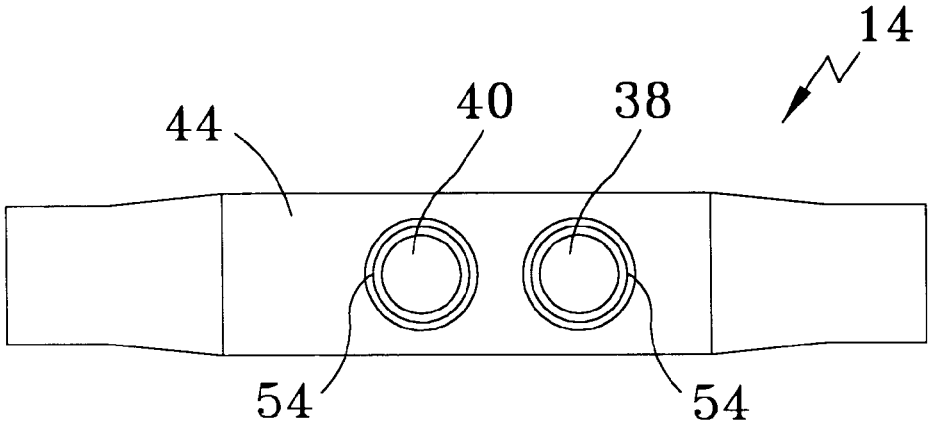
FIG. 6 is a top view of the tubular manifold of the preferred embodiment.

As shown in FIGS. 5 and 6, manifold 14 has an inlet end 32, a discharge end 34 and shaped portion 36, having first manifold port 38 in fluid communication with inlet end 32 and second manifold port 40 in fluid communication with discharge end 34 of manifold 14. First manifold port 38 abuts and is in fluid communication with inlet port 24 of pump housing 12 and second manifold port 40 abuts and is in fluid communication with discharge port 25 of pump housing 12. Fluid from the plumbing system flows into inlet end 32, through first manifold port 38 and inlet port 24 to be pressurized in impeller chamber 20 and then discharged though discharge port 25 and second manifold port 40 and out discharge end 34. For ease of installation the inlet end 32 and discharge end 34 of manifold 14 should extend away from shaped portion 36 a sufficient distance such that when manifold 14 is soldered or brazed into place in the piping system the heat from installation will not harm pump housing 12 (which is made of a non-metallic material) or any seals contained therein. To ensure that the pump 10 is reassembled properly if it is removed and reinstalled in the field, the manifold 14 can have a polarization notch (not shown) in at least one flange of manifold 14 that mates with one or more projections (not shown) molded into pump housing 12.

Figure 7:
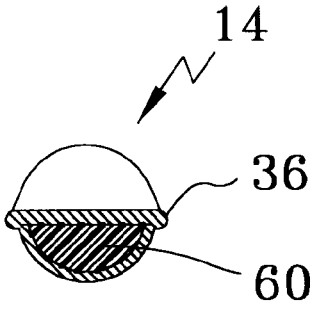
FIG. 7 is a cross-sectional view of the tubular manifold taken through line 7—7 in FIG. 6.

In the preferred embodiment, as shown in FIG. 7, shaped portion 36 has a D-shaped or generally semi-circular cross-section, which can be formed by compressing tubular member 42 in the area where the inlet 24 and discharge 25 ports are desired. The D-shaped cross-section for shaped portion 36 provides a generally planar upper surface 44 to which non-metallic pump housing 12 can connect and seal against. If shaped portion 36 was round, oval or elliptical shaped, pump housing 12 may have problems being able to seal against the curved surface of manifold 14. In addition to sealing problems, the overhanging motor 18 would create a moment force around manifold 14 that could result in slippage of pump housing 12 relative to the piping in the plumbing system in which the circulating pump 10 is used (in those system configurations where the piping is generally horizontal). The D-shaped cross-section for shaped portion 36 is preferred because other shapes which provided a generally planar upper surface 44 investigated by the inventors were either: (1) too difficult or expensive to form and plug between ports 38 and 40; (2) too narrow to utilize any seals between pump housing 12 and manifold 14 to prevent leakage; or (3) too narrow to provide a sufficiently large flow passage through inlet 24 and discharge 25 ports when seals were utilized.

Figure 8:
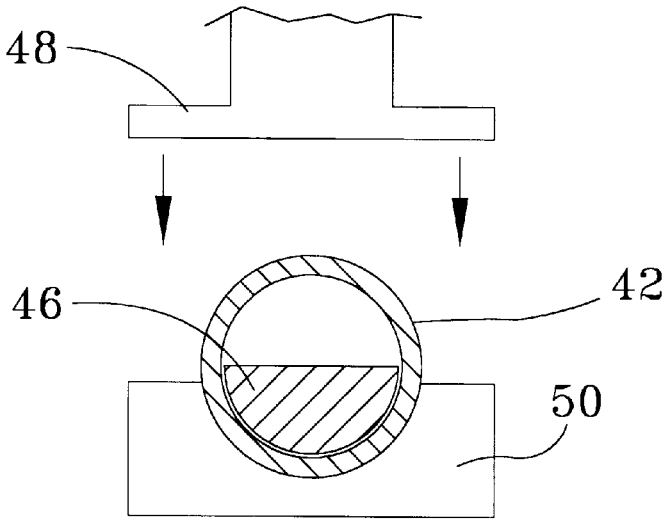
FIG. 8 is cross-sectional view of the formation of the tubular manifold shown in FIG. 5.
Figure 9:
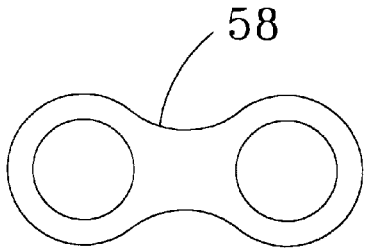
FIG. 9 is a figure-eight shaped gasket seal.

The shaped portion 36 having a generally D-shaped cross-section can be easily formed in a single press stroke, as shown in FIG. 8, by inserting one or more half-round mandrels 46 into tubular member 42 and then squeezing tubular member 42 in the area desired for the shaped portion 36 between a flat platen 48 and a half-round saddle die 50. The half-round mandrels fit the inside diameter of tubular member 42 on one side, leaving the other side open (as shown in FIG. 8). As the pressing operation closes the opening against the half-round portion of the mandrel, the excess tubular material is pushed out to the sides, thereby forming a wide flange-like area on upper surface 44. Planar upper surface 44 must provide sufficient space for seals, such as O-ring, gasket (including flat gaskets or figure eight-shaped gaskets) or other types of seals to be disposed between pump housing 12 and manifold 14 to prevent loss of fluid.

Besides being easier and cheaper to form, use of the above-described method to form manifold 14 provides the relatively large flat surface necessary to sufficiently abut pump housing 12 and locate one or more sealing members. Although the preferred embodiment utilizes O-ring seals 26 around the inlet 24 and discharge 25 ports, these or other types of seals can be located on the manifold 14. Planar upper surface 44 can be shaped and configured to accept various sealing members. For example, as shown in FIG. 6, upper surface 44 can be adapted, such as by cutting or molding, to have one or more O-ring grooves 54 around first 38 and second 40 manifold ports for receiving one or more O-rings 26 (as shown in FIG. 2) in each O-ring groove 54 or to allow use of gasket 58 (such as the figure eight-shaped gasket shown in FIG. 9).

To maintain tubular strength and rigidity, a tubular member 42 can be selected for manifold 14 that has a wall thickness slightly greater (having a slightly smaller inside diameter for the same size outside diameter) than would normally be used for a specific size pipe for the subject piping system. Forced insertion of full round sections of the mandrels can size out the inlet 32 and discharge 34 ends of manifold 14 and keep such ends round for soldering or brazing to the piping system. Inlet 32 and discharge 34 ends of manifold 14 must extend for a distance on either side of shaped portion 36, where pump housing 12 attaches, that is sufficient to avoid unduly raising the temperature of manifold 14 adjacent to non-metallic pump housing 12 and any seals located between pump housing 12 and manifold 14.

As noted previously, it is possible that the O-rings 26, gasket 58 or other sealing members located between the pump housing 12 and manifold 14, particularly if made of EPDM rubber or like materials, can be damaged by the high temperatures used in the soldering and brazing processes. To a lesser extent, it is possible that these processes can also damage housing 12 were it contacts manifold 14. The extension of inlet 32 and discharge 34 ends of manifold 14 reduce the potential for such damage. To further ensure that these sealing member or members are not damaged by the high temperatures of the soldering or brazing processes, an additional temperature barrier can be utilized. One such barrier is the placement of a piece of TFE (i.e., TEFLON, a registered trademark of E.I. du Pont de Nemours & Co.) impregnated fiberglass adhesive tape 56 on the planar upper surface 44 of shaped portion 36 prior to assembly of the pump 10. This tape provides high temperature insulation to protect the more temperature sensitive sealing members. The tape would require pre-configured holes to allow water to pass through inlet port 38 and discharge port 40. The smooth surface and inert nature of such insulating tape (i.e., the TEFLON tape) allows it to remain in place throughout the useful life of pump 10 without adding a tendency toward leaks or deterioration.

Alternatively, instead of the temperature resistant tape, the O-rings 26, gasket 58 or other sealing members can themselves be made of a high temperature resistant material, including elastomers such as fluorocarbon or silicone rubber. Unfortunately, these materials generally lack other properties that are desirable for the sealing members and tend to be considerably more costly. Another alternative is the use of TEFLON coated O-rings 26, gasket 58 or other sealing members between the housing 12 and manifold 14. A thin baked-on layer of TEFLON can insulate the EPDM rubber for the few seconds necessary to prevent deterioration of the sealing member during the soldering or brazing process. Although less expensive than the TEFLON tape and the use of high temperature-resistant materials, coated sealing members tend to have less effective insulating properties.

Figure 10A:
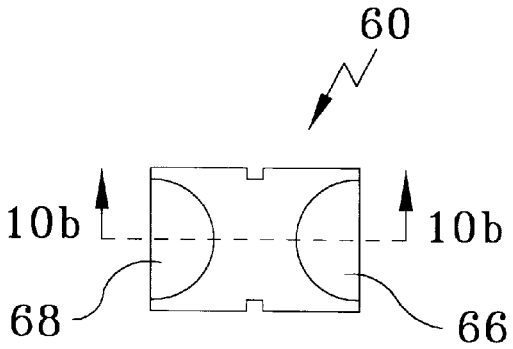
FIG. 10*a* is a top view of the manifold plug.
Figure 10B:
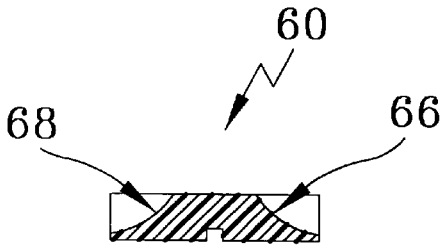
FIG. 10*b* is a cross-sectional view of the manifold plug taken through line 10*b*—10*b* in FIG. 10*a;*

Manifold 14 must have a manifold plug 60, as shown in FIGS. 7, 10*a* and 10*b*) or some other divider between the inlet port 38 and discharge port 40 to separate inlet flow passage 62 and discharge flow passage 64. Manifold plug Go directs the hydraulic path of the fluid into inlet port 24 and from discharge port 25. It is not necessary that manifold plug 60 provide an absolute seal, as losses of a few percent across plug 60 will not be detrimental to the typical application for pump 10. In place of manifold plug 60, a check valve can be used in manifold 14 in parallel with pump 10 such that fluid will go straight through manifold 14 instead of going through pump 10 when the pump 10 is not operating. For this configuration, the shaped portion 36 could be completely round, as opposed to the D-shape of the preferred embodiment, to facilitate placement of the check valve in manifold 14.

Plug 60 must be the same shape as shaped portion 36 and can be made of a variety of materials (plastic may be the most economical). Plug 60 can be inserted into manifold 14 prior to the pressing action to obtain shaped portion 36, thereby clamping plug 60 into shaped portion 36, or it can be inserted into shaped portion 36 after pressing. As best illustrated in FIG. 10*b*, the first end 66 and second end 68 of plug 60 can be shaped to have a toroidal surface (i.e., like the inside of a piping elbow) to provide an improved hydraulic path from inlet end 32 to inlet port 24 and from discharge port 25 to discharge end 34.

Figure 11:
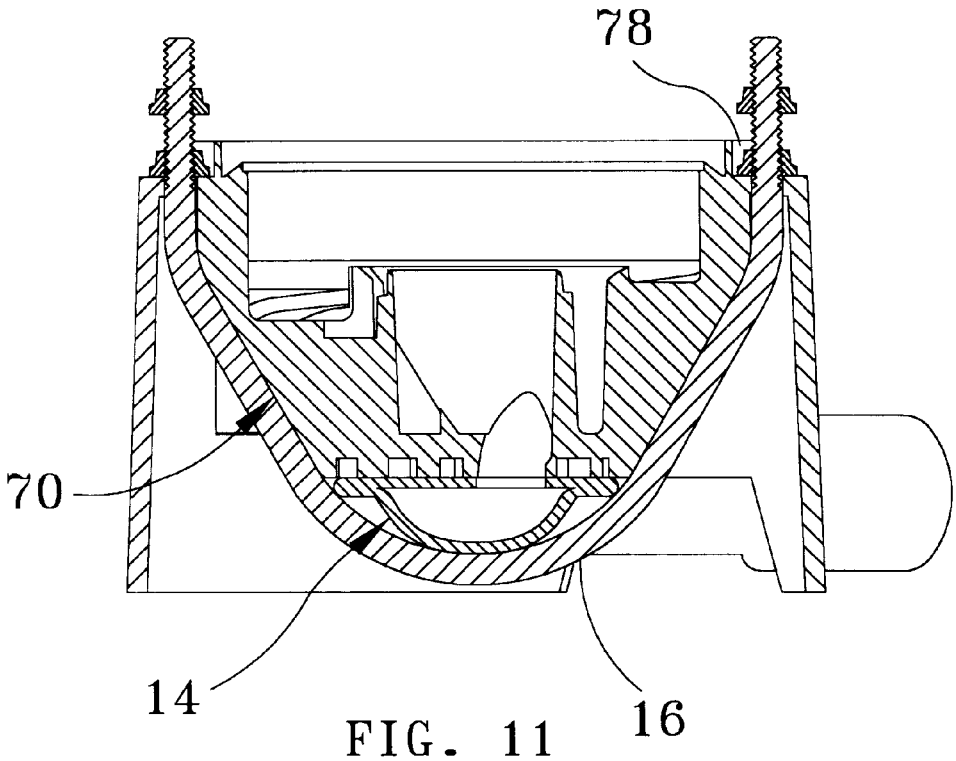
FIG. 11 is a cross-sectional view of the pump housing taken through line 11—11 in FIG. 3 also showing the U-bolt and manifold.

In the preferred embodiment of the present invention 10, manifold 14 is coupled to pump housing 12 by U-bolt 16. U-bolt 16 should be shaped and sized so that it acts as a tension band pulling against the D-shaped portion 36 of manifold 14 and gussets 70 (as shown in FIG. 11), thereby distributing the forces created by connecting pump housing 12 to motor 18. U-bolt 16 should be made of a "soft" steel, such as C1008 low carbon steel, that is elastically or plastically deformable yet strong enough for threads. Deformation of U-bolt 16 allows it to generally conform to the shape of the gussets 70 and manifold 14 to support and distribute its forces. This distribution of forces virtually eliminates tensile forces and bending stresses and places compressive forces on pump housing 12. The compressive forces are substantially normal or perpendicular to the surface of the non-metallic pump housing 12. Tensile forces and bending stresses can result in creep that can lead to cracking of pump housing 12, particularly when exposed to chemicals, or etc. in the piping system. Although the use of U-bolt 16 to couple manifold 14 to pump housing 12 is the preferred embodiment, due to ease of manufacture and costs, other devices can also provide a suitable metallic manifold to non-metallic housing connection. For instance, instead of a U-bolt, a metallic or non-metallic strap (not shown), made of either conformable or compliant material, could be used to couple manifold 14 to pump housing 12 and motor 18.

In the preferred embodiment, the two ends of U-bolt 16 also connect to motor 18 so as to press motor 18 against the side of pump housing 12 opposite the side which abuts manifold 14, thereby placing pump housing 12 in compression between motor 18 and manifold 14. As shown in FIG. 2, the two corners where the ends of U-bolt 16 connect to pump housing 12 and motor 16 should provide space for first nut 72 and a socket wrench to drive first nut 72 (one at each end of U-bolt 16). Second nuts 74 are utilized to connect motor 18 to pump housing 12. First nut 72 will hold pump housing 12 in place against manifold 14 when second nut 74 is removed to separate pump housing 12 from motor 18 to avoid breaking any seals between pump housing 12 and manifold 14. To fit the tight clearances, a reduced hex (i.e., aircraft) nut is utilized with U-bolt 16, which allows a smaller socket wrench to fit into the limited space. Connectors, such as motor screws 75, can be utilized at the other two corners where the pump housing 12 connects to motor 18 to securely join the housing 12 to motor 18.

Figure 12:
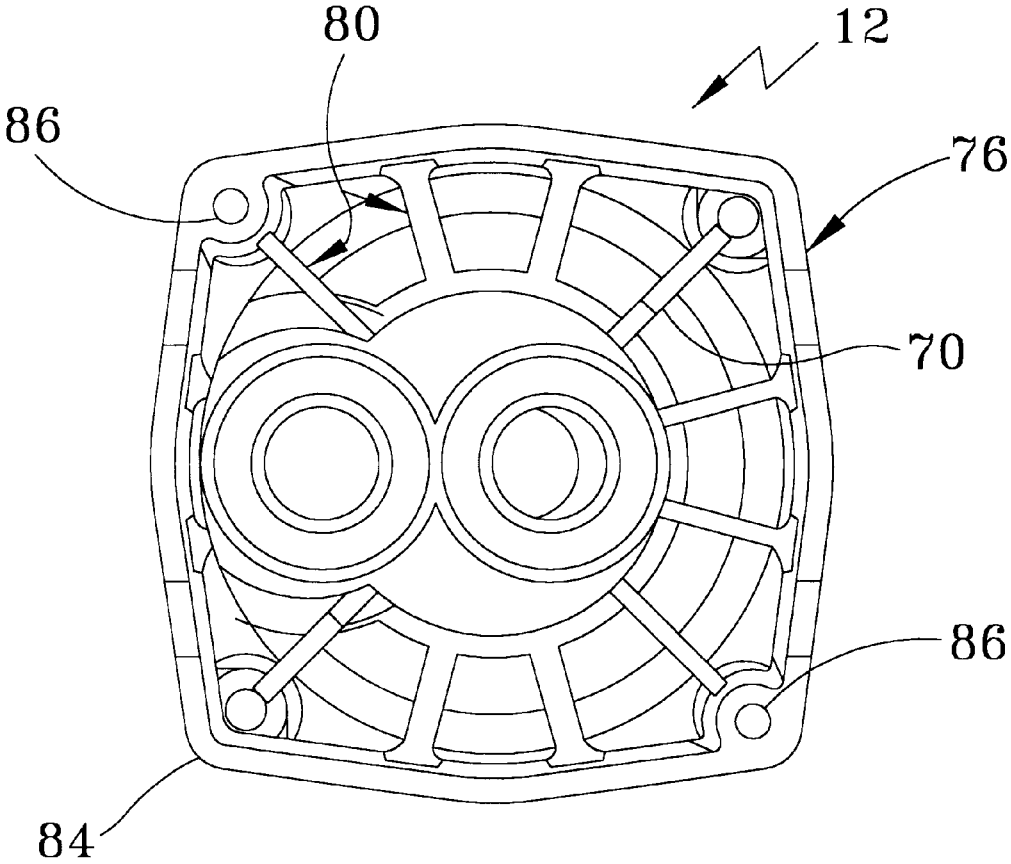
FIG. 12 is a view of the pump housing in FIG. 1 from the tubular manifold side of the pump housing.

The outer portion of pump housing 12 can be a four-sided outer skirt 76 that peripherally stiffens and strengthens skirt edge 77 that abuts motor 18. As shown in FIG. 12, a plurality of radial intercostals 80 tie the skirt 76 to the main portion of pump housing 12 to provide additional stiffening and strengthening benefits. A shallow, wide notch on each side of skirt 76 can function to align and support the edges and flat surface of the shaped portion 36 of manifold 14. The pump housing 12 can have various "dead spaces" formed by annular gaps in the housing 12 to avoid having a thick plastic wall (such as the pair of concentric slots 82 about the discharge port 25 in FIG. 3).

As shown in FIG. 12, two diagonally opposite corners of the four corners (designated jointly as 84) of outer skirt 76 of pump housing 12 can each have a mounting boss 86 to form a flat surface and a socket in which to engage a mounting screw (not shown) for mounting purposes. Some installations require the flat surface for mounting circulating pump 10. The mounting bosses 86 and skirt 76 can extend just past the rounded end of U-bolt 16 (as shown in FIG. 11).

Figure 13:
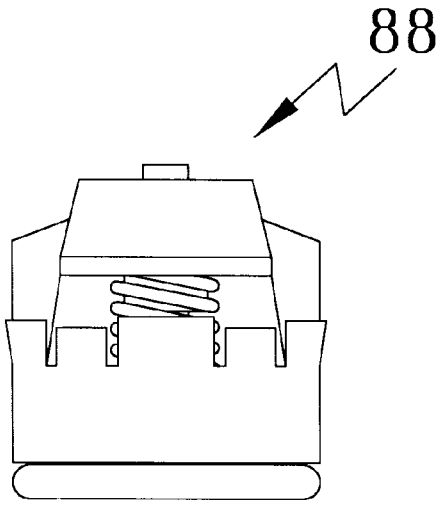
FIG. 13 is a side view of a check valve that can be used with the pump unit of the present invention.
Figure 14:
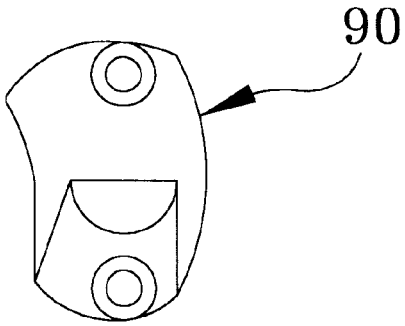
FIG. 14 is a clamping flange used to hold the check valve of FIG. 13 in place.

Check valve 88, an example of which is illustrated in FIG. 13, can be provided in pump housing 12 within inlet port 24 or discharge port 25 to prevent thermal siphoning of heating system hot water through the pump circuit when no heat is desired. For instance, siphoning of hot water from a dual-purpose hot water heater would defeat the purpose of an air conditioning system built into the same unit. Placing check valve 88 inside pump housing 12, as opposed to elsewhere in the piping system, reduces the installation costs and the potential for external leaks by eliminating the extra connections that would be necessary to independently place the check valve in the piping system and to provide accessability for a field-serviceable check valve.

In the preferred embodiment, check valve 88 is located in discharge port 25 to allow the pump to vent air upon start-up, which avoids air-binding (condition where the impeller is spinning in air). For ease in replacing check valve 88 when necessary, the preferred embodiment is configured so that check valve 88 is removable from pump housing 12, by disconnecting motor 18 from pump housing 12, without removing pump 10 from the piping system, thereby eliminating the need to violate the integrity of the piping system to replace a worn or bad check valve 88. Check valve 88 can be a large cartridge check valve if the space leading to and at discharge port 25 is sufficient. Check valve 88 can be held in place by a clamping flange 90, shown in FIG. 14. Clamping flange 90 can also function as a cutwater to redirect fluid flow from the peripheral to axial flow, resulting in a smoother, more efficient hydraulic flow path. When it is not needed, higher flows can be achieved by not using check valve 88.

Figure 15:
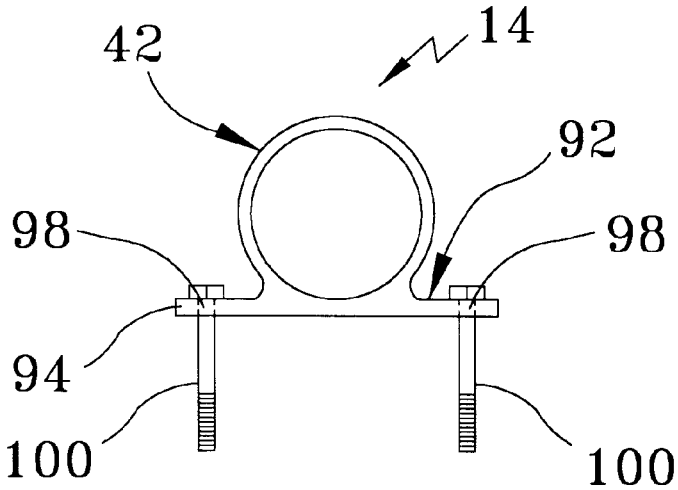
FIG. 15 is alternative embodiment of the tubular manifold for use with the pump unit of the present invention.
Figure 16:
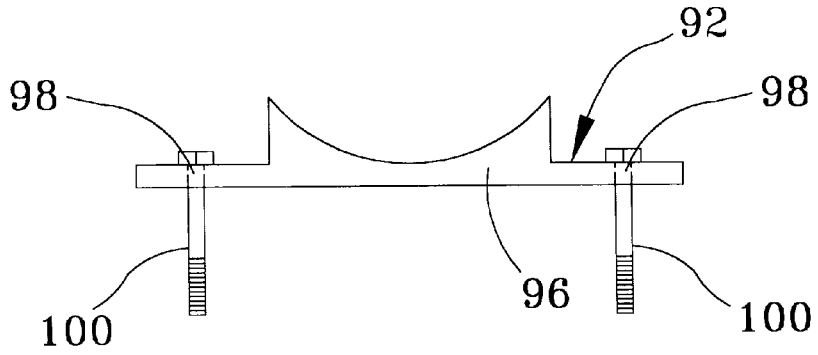
FIG. 16 is another alternative embodiment of the tubular manifold for use with the pump unit of the present invention.

In an alternative embodiment of the circulating pump of the present invention 10, shaped portion 36 could comprise a manifold 14 having a circular cross-section throughout with any rigid or semi-rigid clamping member, shown generally as 92 in FIGS. 15 and 16, integral with or attached thereto, such as flat portion 94 integral with tubular member 42 (as shown in FIG. 15) or tubular member 42 with a brazed-on foot 96 (as shown in FIG. 16). Member 92 can be a saddle, clamp, drawplate or such which extends beyond the width of tubular member 42 and have openings 98 therein for passage of one or more draw bolts 100. If member 92 is rigid, the extension of member 92 beyond the width of tubular member 42 and the diameter of pump housing 12 would allow draw bolts 100 to remain essentially parallel to each other. Draw bolts can engage motor 18 directly, connect with one or more nuts (not shown) or a rigid member abutting motor 18 (not shown), thereby avoiding potential damage to the non-metallic pump housing 12. If member 92 is semi-rigid, such that it can deflect elastically or plastically, it can not only hold manifold 14 against pump housing 12, but also itself bear against the pump housing 12 to accomplish some of the same effects as U-bolt 16 or the strap member discussed above. Although the alternatives would be more expensive to manufacture, they could provide a greater flow area leading to and from the inlet 24 and discharge 25 ports.

Figure 17:
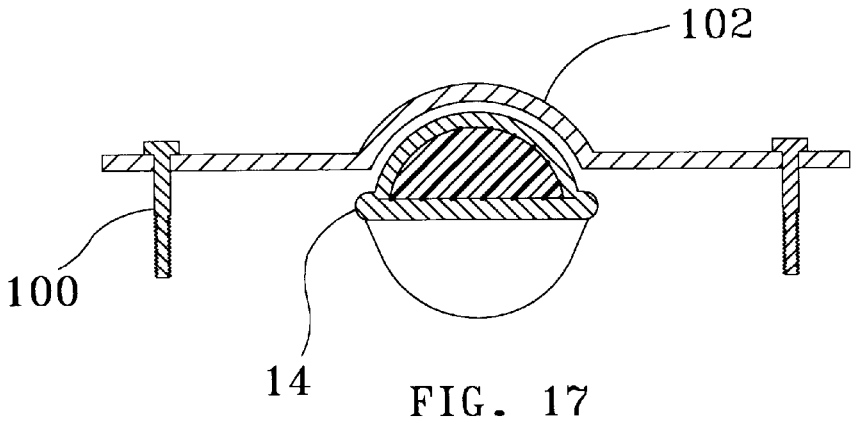
FIG. 17 is a cross-sectional view of a drawplate that can be used to clamp the manifold to the pump housing.

In another alternative embodiment of the present invention, a drawplate 102 (shown in FIG. 17) or other type of generally rigid clamping member can be used in place of U-bolt 16 to clamp tubular manifold 14 to pump housing 12. As illustrated in FIG. 17, drawplate 102 can have a saddle-shaped section that generally conforms to the shape of tubular manifold 14 to better hold tubular manifold 14 in place. Draw bolts 100 can be utilized to clamp tubular manifold 14 to the pump housing 12. If properly sized and configured, drawplate 102 increases the effective width of tubular manifold 14 so that four generally parallel draw bolts 100 can be used, one at each corner of pump housing 12. The same set of draw bolts 100 can also engage the motor 18. As with the use of U-bolt 14, the use of drawplate 102 or other clamping member allows the non-metallic housing 12 to be clamped between two pieces of metal (i.e., the manifold 14 and motor 18), which is important to virtually eliminate any significant tensile or bending stresses in housing 12.

Although drawplate 102 should be generally rigid, in its preferred use it is made of a material that allows drawplate 102 to deflect elastically or plastically. A truly rigid member will clamp the tubular manifold 14 against the pump housing 12, but it will not specifically support the corners through which draw bolts 100 pass. If drawplate 102 is able to deflect elastically or plastically such that it bears against the four corners of the pump housing 12, it will support all four corners (as occurs with the use of U-bolt 16 at two corners) in addition to clamping manifold 14 against pump housing 12 to keep the pump housing 12 in compression between the metallic components.

Figure 18:
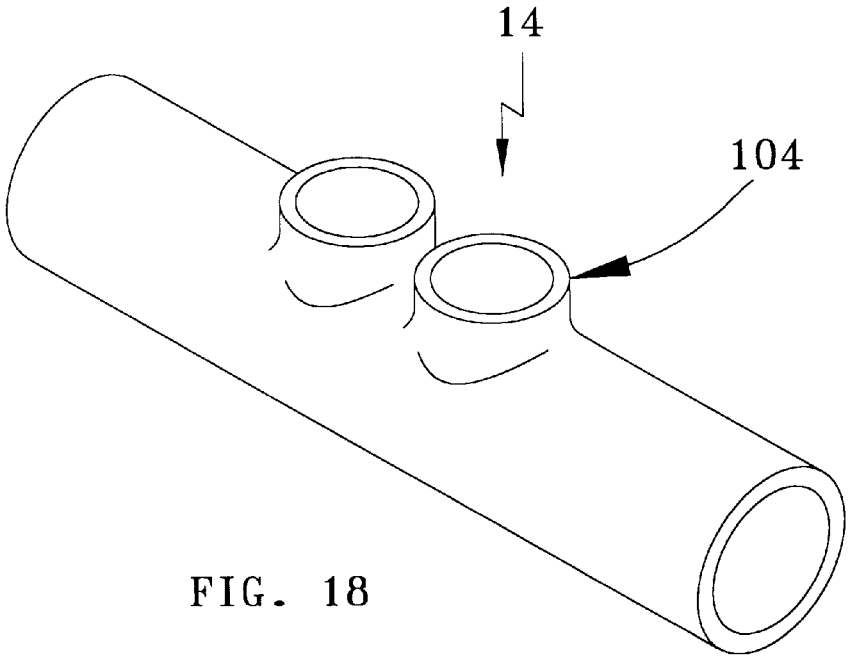
FIG. 18 is yet another alternative embodiment of the tubular manifold for use with the pump unit of the present invention.

In another alternative embodiment, shown in FIG. 18, a circular cross-section can have a pair of protruding branches 104 extending from manifold 14 to inlet port 24 and discharge port 25. Protruding branches 104 can have mating pockets (not shown) in pump housing 12 to prevent rotation of pump unit 10.

In addition to the shaped portion braze-in-place manifold 14 described above, the pump housing 12 of the present invention 10 can be used with other special purpose manifolds. Examples of such uses (not shown) include: (1) a longer D-shaped manifold that has a connection or mount for a vent valve; (2) a shaped metal or plastic manifold with barbed ends for hose or flexible plumbing; (3) item 2 with grooved pipe ends; (4) a non-metallic manifold that has socket ends to accept beaded copper tubes with radial O-ring seals and a keeper clip or pin; (5) a manifold of PVC, CPVC, ABS or other solvent-cementable plastic material having slip joint ends; (6) a non-in-line (i.e., end suction) manifold with various port configurations; and (7) a mount that connects directly to customer supplied interfaces.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use.

What is claimed is:

1. A circulating pump for use in a piping system, comprising:

a pump housing having an inlet port, discharge port and an impeller chamber, said impeller chamber in fluid communication with said inlet port and said discharge port, said impeller chamber having an impeller disposed therein, said pump housing made from a non-metallic material;

a manifold having a shaped portion, an inlet end and a discharge end, said shaped portion having a first manifold port and a second manifold port, said first manifold port in fluid communication with said inlet port, said second manifold port in fluid communication with said discharge port, said inlet and discharge ends suitable for connecting said manifold to the piping system;

coupling means for coupling said manifold to said pump housing; and a motor abutting said pump housing and operatively connected to said impeller.

2. The circulating pump according to claim 1, wherein said non-metallic material is plastic.

3. The circulating pump according to claim 1, wherein said non-metallic material is a composite material.

4. The circulating pump according to claim 1, wherein said pump housing has a volute form.

5. The circulating pump according to claim 1, wherein said shaped portion has a generally planar upper surface, said first manifold port and said second manifold port in said generally planar upper surface.

6. The circulating pump according to claim 5, wherein said shaped portion is integral with said manifold.

7. The circulating pump according to claim 6, wherein said shaped portion is formed by pressing a generally flat platen against one side of a tubular member having one or more half-round mandrels therein.

8. The circulating pump according to claim 1 further comprising sealing means disposed between said pump housing and said manifold for sealing the fluid flow between said first manifold port and said inlet port and between said second manifold port and said discharge port to prevent leakage of fluid therefrom.

9. The circulating pump according to claim 1 further comprising a manifold plug disposed in said shaped portion of said manifold between said first manifold port and said second manifold port, said manifold plug forming an inlet passage and a discharge passage in said manifold for directing fluid to and from said impeller chamber.

10. The circulating pump according to claim 9, wherein said manifold plug has a first end and a second end, said first end and said second end shaped to provide improved hydraulic flow of fluid inside said inlet passage and said discharge passage.

11. The circulating pump according to claim 1 further comprising a check valve operatively disposed in said pump housing.

12. The circulating pump according to claim 11, wherein said check valve is disposed in said discharge port of said pump housing.

13. The circulating pump according to claim 11, wherein said check valve is removable from said pump housing without disconnecting said manifold from the piping system.

14. The circulating pump according to claim 1, wherein said shaped portion is shaped and configured to further comprise sealing means disposed between said pump housing and said manifold for sealing the fluid flow between said first manifold port and said inlet port and between said second manifold port and said discharge port to prevent leakage of fluid therefrom.

15. The circulating pump according to claim 14, wherein said sealing means comprises one or more O-ring grooves around each of said first manifold port and said second manifold port and one or more O-rings in each of said O-ring grooves.

16. The circulating pump according to claim 14, wherein said sealing means comprises a gasket.

17. The circulating pump according to claim 14, wherein said sealing means further comprises temperature resistant means for preventing heat damage to said sealing means or said pump housing.

18. The circulating pump according to claim 1, wherein said inlet and discharge ends of said manifold are made of material suitable for soldering or brazing said manifold to a metallic piping system.

19. The circulating pump according to claim 1, wherein said inlet and discharge ends of said manifold are tubular shaped and said inlet end is opposite said discharge end.

20. The circulating pump according to claim 1, wherein said coupling means comprises a U-bolt.

21. The circulating pump according to claim 1, wherein said coupling means comprises a clamping member having one or more connecting means for connecting said clamping member to said pump housing.

22. The circulating pump according to claim 1, wherein said coupling means is deformable.

23. The circulating pump according to claim 1, wherein said coupling means further couples said pump housing to said motor.

24. The circulating pump according to claim 23, wherein said coupling means is configured such that said motor is removable from said pump housing without separating said manifold from said pump housing.

25. The circulating pump according to claim 1, wherein said coupling means places said pump housing in compression between said manifold and said motor.

26. The circulating pump according to claim 1 further comprising a plurality of fins radially arranged in said inlet port, said plurality of fins configured to improve the flow characteristics of fluid to said impeller chamber.

27. A circulating pump, comprising:

a pump housing having an inlet port, discharge port and an impeller chamber, said impeller chamber in fluid communication with said inlet port and said discharge port, said impeller chamber having an impeller disposed therein, said pump housing made from a non-metallic material;

a manifold abutting said pump housing, said tubular manifold having a shaped portion, an inlet end and a discharge end, said shaped portion having a generally planar upper surface, a first manifold port and a second manifold port, said first manifold port and said second manifold port disposed in said generally planar upper surface, said first manifold port in fluid communication with said inlet port, said second manifold port in fluid communication with said discharge port, said inlet and discharge ends suitable for connecting said manifold to the piping system;

a manifold plug disposed in said shaped portion of said manifold between said first manifold port and said second manifold port, said manifold plug forming an inlet passage and a discharge passage in said manifold for directing fluid to and from said impeller chamber;

a motor abutting said pump housing and operatively connected to said impeller; and coupling means for coupling said manifold to said pump housing and said motor, said coupling means placing said pump housing in compression between said manifold and said motor.

28. The circulating pump according to claim 27, wherein said generally planar upper surface is shaped and configured to further comprise sealing means disposed between said pump housing and said manifold for sealing the fluid flow between said first manifold port and said inlet port and between said second manifold port and said discharge port to prevent leakage of fluid therefrom.

29. The circulating pump according to claim 28, wherein said sealing means comprises one or more O-ring grooves around each of said first manifold port and said second manifold port and one or more O-rings in each of said O-ring grooves.

30. The circulating pump according to claim 28, wherein said sealing means comprises a gasket.

31. The circulating pump according to claim 28, wherein said sealing means further comprises temperature resistant means for preventing heat damage to said sealing means or said pump housing.

32. The circulating pump according to claim 27, wherein said manifold plug has a first end and a second end, said first end and said second end shaped to provide improved hydraulic flow of fluid inside said inlet passage and said discharge passage.

33. The circulating pump according to claim 27, wherein said coupling means is deformable.

34. The circulating pump according to claim 27 further comprising a check valve operatively disposed in said pump housing.

35. A circulating pump, comprising:

a pump housing having an inlet port, discharge port and an impeller chamber, said impeller chamber in fluid communication with said inlet port and said discharge port, said impeller chamber having an impeller disposed therein, said pump housing made from a non-metallic material;

a manifold abutting said pump housing, said tubular manifold having a shaped portion, an inlet end and a discharge end, said shaped portion having a generally planar upper surface, a first manifold port and a second manifold port, said first manifold port and said second manifold port disposed in said generally planar upper surface, said first manifold port in fluid communication with said inlet port, said second manifold port in fluid communication with said discharge port, said inlet and discharge ends suitable for connecting said manifold to the piping system;

a manifold plug disposed in said shaped portion of said manifold between said first manifold port and said second manifold port, said manifold plug forming an inlet passage and a discharge passage in said manifold for directing fluid to and from said impeller chamber, said manifold plug having a first end and a second end, said first end and said second end shaped to provide improved hydraulic flow of fluid inside said inlet passage and said discharge passage;

sealing means disposed between said pump housing and said manifold for sealing the fluid flow between said first manifold port and said inlet port and between said second manifold port and said discharge port to prevent leakage of fluid therefrom;

a motor abutting said pump housing and operatively connected to said impeller; and coupling means for coupling said manifold to said pump housing and said motor, said coupling means being deformable and placing said pump housing in compression between said manifold and said motor.

36. The circulating pump according to claim 35 further comprising a check valve operatively disposed in said pump housing.

37. The circulating pump according to claim 35, wherein said sealing means further comprises temperature resistant means for preventing heat damage to said sealing means or said pump housing.

* * * * *